US005875498A

United States Patent [19]

Joseph

[11] Patent Number: 5,875,498

[45] Date of Patent: Mar. 2, 1999

[54] TOILET SEAT LIFTING DEVICE

[76] Inventor: John Gibson Joseph, 3305 C.H. 47, Upper Sandusky, Ohio 43351

[21] Appl. No.: 80,978

[22] Filed: May 19, 1998

[51] Int. Cl.[6] ..... A47K 13/10

[52] U.S. Cl. ..... 4/246.5; 4/246.1; 4/246.4

[58] Field of Search ..... 4/246.1, 246.3, 4/246.4, 246.5, 248, 241, 237, 667

[56] References Cited

U.S. PATENT DOCUMENTS

| | | | |
|---|---|---|---|
| 621,790 | 3/1899 | Burger et al. . | |
| 1,509,242 | 9/1924 | Kuno | 4/246.4 |
| 1,511,533 | 10/1924 | Staszak . | |
| 1,590,298 | 6/1926 | Landis . | |
| 2,136,684 | 11/1938 | Greavu | 4/246.5 |
| 2,632,896 | 3/1953 | Morikawa . | |
| 2,954,565 | 10/1960 | Miller . | |
| 3,516,095 | 6/1970 | Clifton et al. . | |
| 4,150,446 | 4/1979 | Crocker . | |
| 5,075,906 | 12/1991 | Robbins . | |
| 5,327,589 | 7/1994 | Rice . | |

*Primary Examiner*—David J. Walczak
*Attorney, Agent, or Firm*—George C. Atwell

[57] ABSTRACT

A toilet seat lifting device for selectively raising and lowering the seat of a toilet includes a base disposed on a floor surface, a stanchion secured to the front of the base, and a foot pedal pivotably mounted to the stanchion. A plurality of link arms are pivotably mounted to the stanchion and are linked to the foot pedal so that movement of the foot pedal pivots the link arms. Mounted to the distal ends of the link arms is a lifting arm retaining member which carries an elongated lifting arm capable of vertical repositioning on the lifting arm retaining member to accommodate variously-sized toilet bowls and seats. The upper end of the lifting arm is attached to the under-side of the toilet seat. A main spring attached to the link arms assists in raising and dampens the lowering of the toilet seat, and a helper spring projecting upwardly from the base between the link arms engages when the toilet seat goes past the top dead center position in order to assist in returning the toilet seat to the lowered state.

3 Claims, 3 Drawing Sheets

TOILET SEAT LIFTING DEVICE

BACKGROUND OF THE INVENTION

The present invention comprehends bathroom or lavatory accessory items, and more particularly pertains to a toilet seat lifting device for raising and lowering toilet seats.

Safety, convenience, accessibility, and hygiene are primary factors to consider in designing, building, and using bathrooms, lavatories, and public restrooms. For example, with the passage of the Americans With Disabilities Act in the early 1990's, public restrooms have been redesigned for easy access and use by physically impaired and disabled individuals. Enlarged stalls, easy to reach handrails, and full length mirrors for wheelchair bound individuals are just a few of the improvements added to public restrooms for enhancing their convenience and access as required by the aforesaid Act.

In addition, whether the bathroom is private or public, hygiene is a paramount concern. Warm air blowers for drying the hands, anti-bacterial soap dispensers, and motion-activated faucets are common features in public restrooms. The toilet, however, remains the primary source of pathogenic—and sometimes lethal—bacteria. The toilet seat, lid, rim, tank, and bowl surfaces are rife with bacteria and, given the haste and inattentiveness that accompanies restroom visits—especially public restrooms—it is inevitable that harmful bacteria will be deposited, by direct or indirect means, on the individual because of the difficulty of using the toilet while at the same time avoiding direct physical contact therewith. A major problem arises in raising and lowering the toilet lid and seat while minimizing the amount and duration of physical contact needed to accomplish the task which, in turn, minimizes the chances of pathogenic bacteria transmission.

A number of devices have been invented to accomplish this task quickly, efficiently, and with a minimum of physical contact with the bacteria laden surfaces. U.S. Pat. No. 1,590,298 (Landis), U.S. Pat. No. 3,516,095 (Clifton et al.), and U.S. Pat. No. 5,327,589 (Rice) disclose toilet seat lifting devices that use pneumatic cylinder assemblies to control the raising and lowering of the toilet seat and lid. In addition, U.S. Pat. No. 621,790 (Burger et al.), U.S. Pat. No. 1,511,533 (Staszak), U.S. Pat. No. 2,632,896 (Morikawa), U.S. Pat. No. 2,954,565 (Miller), U.S. Pat. No. 4,150,446 (Crocker), and U.S. Pat. No. 5,075,906 (Robbins) disclose devices for raising and lower toilet seats that incorporate rods, bars, or links that pivot to raise and lower the toilet seat when actuated by some type of foot pedal.

There remains a need, however, for a toilet seat lifting device that can both raise the toilet seat and/or lid in a smooth, continuous manner and also lower the toilet seat and/or lid in a smooth, controlled manner, and which requires very little force or effort to effectuate the raising and lowering of the toilet seat and lid.

SUMMARY OF THE INVENTION

The present invention comprehends a toilet seat lifting device for raising and lowering a toilet seat in a smooth, controlled manner through the application of very little force or effort.

The toilet seat lifting device of the present invention includes a base which is slidably repositionable on the floor surface adjacent the toilet, a stanchion mounted to the base and projecting upwardly adjacent to the toilet bowl, a plurality of link arms and a foot pedal pivotably mounted to the stanchion, a lifting arm secured to the distal end of the link arms and projecting upwardly adjacent the rear of the toilet seat whereupon the upper end of the lifting arm is received by a bracket which is mounted to the underside of the toilet seat. A main spring attached to the stanchion and the distal ends of the link arms assists in the raising of the toilet seat and dampens the lowering of the toilet seat, and a helper spring secured to the base and projecting upwardly therefrom interacts with the link arms to lower the toilet seat if the toilet seat should happen to pivot past the top dead center position. The helper spring is actuated only when the toilet seat goes past the top dead center position.

It is an objective of the present invention to provide a toilet seat lifting device which is easy to set up and can accommodate toilets of various shapes and sizes.

It is another objective of the present invention to provide a toilet seat lifting device which is easy to operate and requires little force or effort to raise the toilet seat.

Yet another objective of the present invention is to provide a toilet seat lifting device which controls the lowering of the toilet seat so that the seat does not slam against the toilet bowl.

These and other objects and advantages will be readily apparent upon a study of the following detailed description and the accompanying drawings.

DETAILED DESCRIPTION OF THE PREFERRED EMBODIMENT

Figure 2:
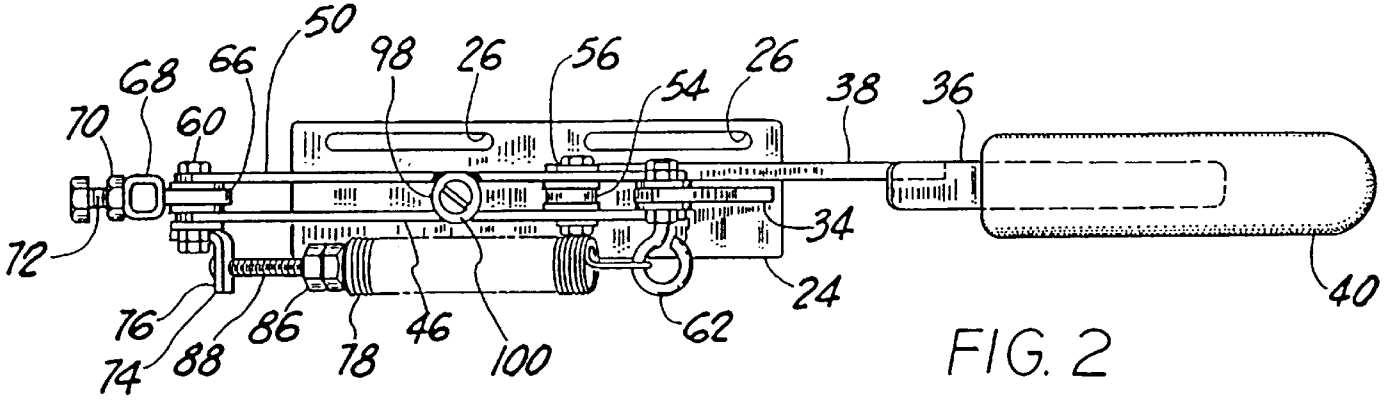
FIG. 2 is a top plan view of the toilet seat lifting device first shown in FIG. 1.

Illustrated in FIGS. 1–5 is a toilet seat lifting device 10 for allowing an individual to selectively raise and lower a toilet seat by the application of a slight force from the individual's foot 11 so that the toilet seat can be raised and lowered in a smooth, continuous manner without jarring or slamming the seat during raising or lowering. The device 10 is disposed on a floor surface 12 adjacent the bowl of a standard water closet or toilet 14 located in any bathroom, restroom, or lavatory facility, either public or private. The toilet 14 includes the standard features: toilet bowl 16, toilet tank 17, toilet seat 18, toilet lid 20, and a hinge 22 for the seat 18 and lid 20. While the device 10 can lift both the lid 20 and the seat 18, it is primarily designed for raising and lowering the seat 13. Furthermore, because very little force or effort needs to be applied by the individual's foot 11 to lift the range of toilet seats that exists in the market, the device 10 is well suited for small children, convalescing individuals, geriatric patients, and the elderly.

Figure 1:
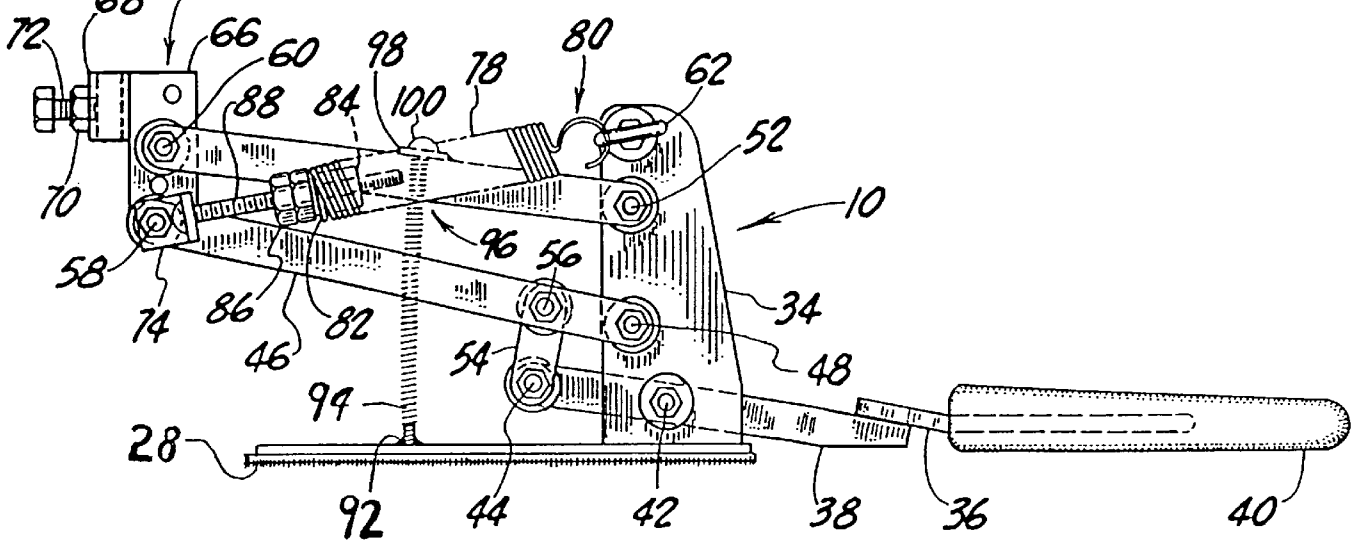
FIG. 1 is a fragmentary side elevational view of the toilet seat lifting device of the present invention.
Figure 3:
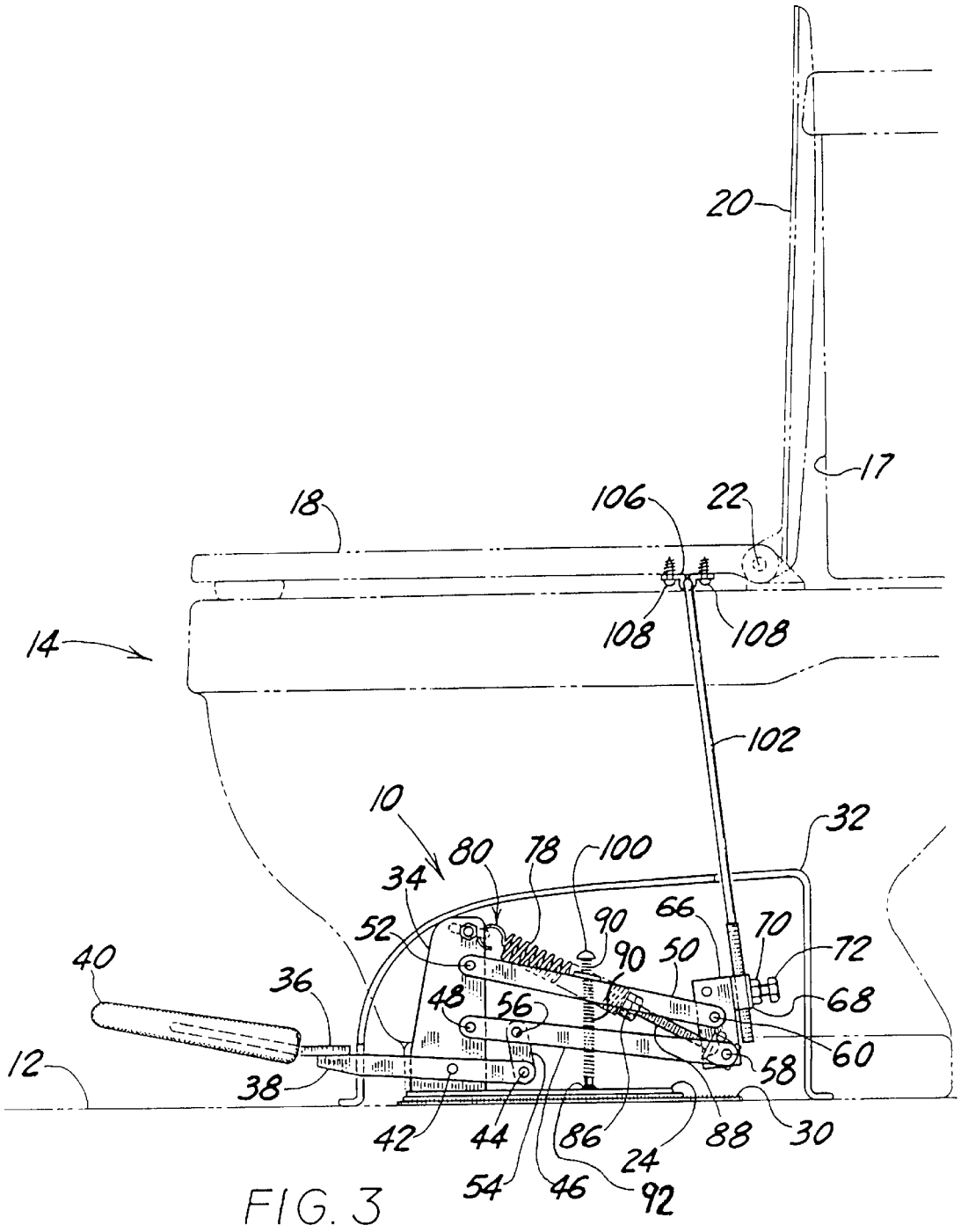
FIG. 3 is a side elevational view of the toilet seat lifting device in the non-use or lowered state.
Figures 4, 5:
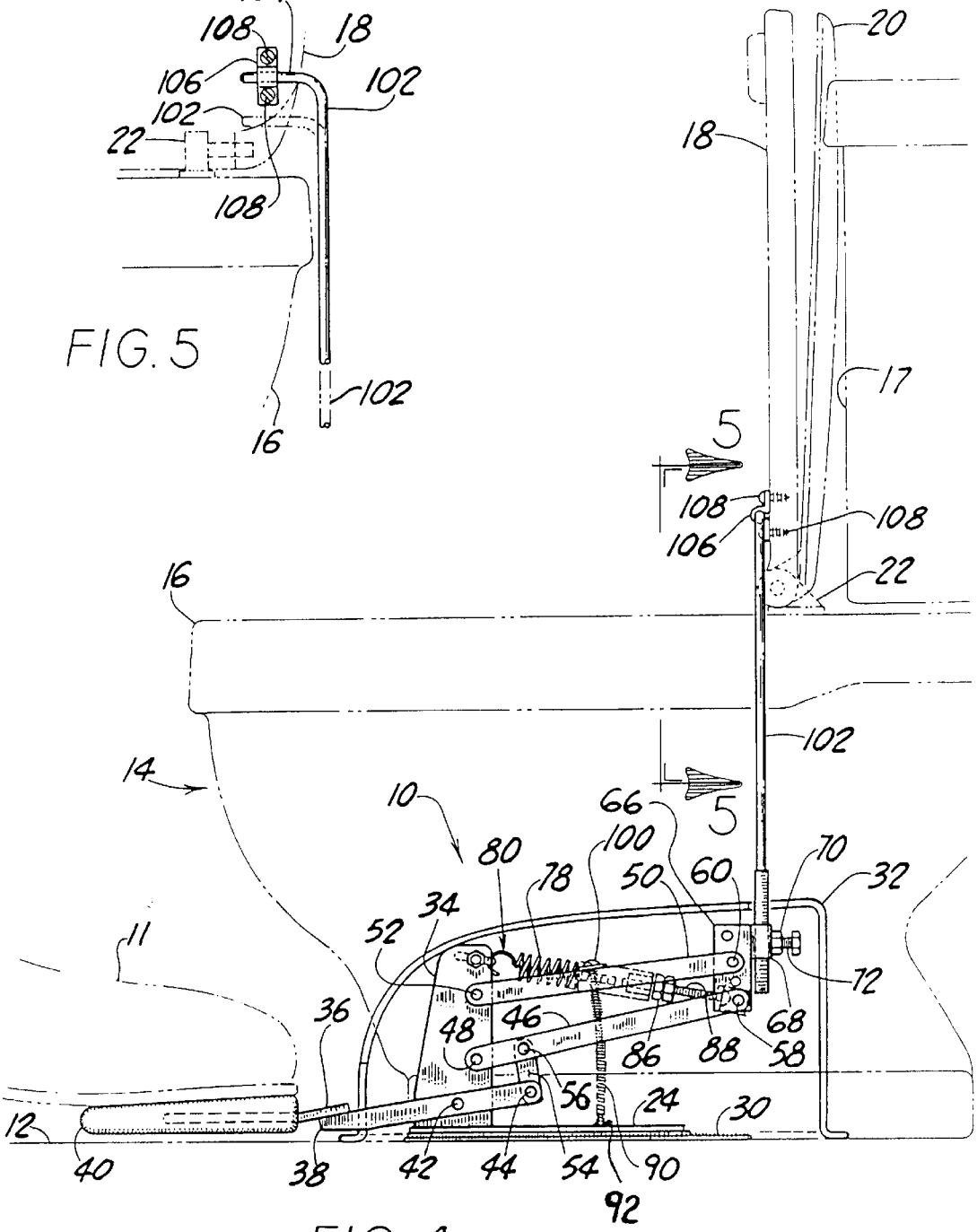
FIG. 4 is a side elevational view of the toilet seat lifting device first shown in FIG. 1 illustrating the use or raising state thereof.
FIG. 5 is a fragmentary side elevational view of the toilet seat lifting device first shown in FIG. 1 illustrating the attachment of the lifting arm to a bracket secured to the underside of the toilet seat.

As illustrated in FIGS. 1–4, the device 10 includes a flat, elongated floor plate or base 24 which is disposed contiguous to the floor surface 12. The base 24 includes at least one elongated floor securement slot 26 (the present invention uses two slots 26) adjacent a long edge thereof, and one or more fasteners (not shown), such as elongated wood screws, for passing through the slots 26 and into the floor surface 12 for securing the base 24 thereto. In addition, an alternative method of securing the base 24 to the floor surface 12 is illustrated in FIGS. 1–3. Attached to the underside of the base 24 is a strip 28 of VELCRO material, and also attached by means of an adhesive to the floor surface 12 adjacent and to one side of the bowl 16 is a second strip 30 of VELCRO material. The base 24 is attached to the strip 30 by pressing the base 24 down upon the strip 30 so that the strips 28 and 30 are attached together. The base 24 can be easily repositioned by simply lifting it up off the strip 30 and then placing the base 24 down upon the strip 30 at a different position. As shown in FIGS. 3 and 4, a cover 32, preferably of molded plastic, can be placed over the majority of the structural elements of the device 10 for protection and for providing a more aesthetic appearance for the device 10.

Projecting upwardly from the base 24 is a stanchion 34, as shown in FIGS. 1–4. The stanchion 34 is a flat, generally rectangular-shaped plate disposed toward the front of the base 24. The stanchion 34 projects upwardly adjacent one side of the bowl 16. Pivotably mounted to the stanchion 34 is a foot pedal 36. The pedal 36 is pivotably mounted to the stanchion 34 by means of a pedal bar 38, and the pedal 36 itself can simply be a thin, elongated metal bar. In order to protect the individual's foot 11 from possible injury when using the device 10 and to provide more surface area for the user's foot to apply a downward force thereagainst, a protective sleeve or covering 40 can be placed or slipped over the pedal 36, and the covering 40 can be a flexible, rubber material. The pedal bar 38 is secured to the stanchion 34 by a stanchion pivot 42 and, for purposes of orientation, the front and rear of the device 10 will be denoted as follows: the front of the device 10 includes the pedal 36, the pedal bar 38, and the stanchion 34; and the rear of the device 10 includes all of those elements located behind the stanchion 34. The pedal bar 38 also includes a second pivot 44, the purpose of which will be hereinafter further described.

As shown in FIGS. 1–4, the device 10 includes a means to transmit and convert the downwardly-directed force of the individual's foot 11 against the pedal 36 into an upwardly-directed force for raising the seat 18. The device 10 utilizes a linkage means for transmitting the force applied by the individual's foot against the pedal 36 into a force for raising the seat 18. The linkage means includes a plurality of elongated, lower link arms 46 which are secured to and extend rearwardly of the stanchion 34 for pivotable movement thereon by a lower link arm pivot 48. The linkage means also includes at least one, and perhaps two, upper link arms 50 secured to the upper end of the stanchion 34 by an upper link arm pivot 52. The pedal bar 38 is not directly linked to the link arms 46 and 50; therefore, secured to the second pivot 44 at the distal end of the pedal bar 38 is a relatively short intermediate link arm 54 which is pivotably secured to both link arms 46 by an intermediate link arm pivot 56. Furthermore, the distal ends of the link arms 46 include a lower link arm distal pivot 58, and the distal end of the link arm 50 includes an upper link arm distal pivot 60. In the present invention all of the above-described pivots 42, 44, 48, 52, 56, and 58 are fasteners, such as machine or carriage bolts with accompanying washers and nuts, that are inserted through apertures (not shown) in the stanchion 34, the pedal bar 38, the link arms 46 and 50, and the link arm 54 for securing these elements together so that pivotable movement is possible.

As shown in FIGS. 1–4, secured to the upper end of the stanchion 34 is a rod eye. Specifically, the rod eye is an eye bolt 62 extending transversely through the stanchion 34 and secured thereto by accompanying washers and nuts. Although the eye bolt 62 is capable of rotatable movement on the stanchion 34, the operation of this device 10 does not require rotation of the eye bolt 62.

As shown in FIGS. 1–4, a lifting arm retaining member 64 is secured to the distal ends of the link arms 46 and 50. The lifting arm retaining member 64 includes a flat support plate 66 which is attached to the link arms 46 and 50 by the pivots 58 and 60 and a lifting arm receiving tube 68 which may be a square- or circular-shaped bushing. The tube 68 includes an aperture (not shown) on its rearwardly-facing surface to which is secured an internally-threaded stud or nut 70. A set screw 72 can be inserted through the nut 70 and the aperture of the tube 68. Also secured to the plate 66 by means of the pivot 58 is an L-shaped bracket 74 having a leg portion 76 extending at a right angle to the plate 66. The leg portion 76 includes an aperture (not shown) extending therethrough.

As shown in FIGS. 1–4, a means for assisting in the raising of the seat 18 and for dampening the lowering of the seat 18 is an integral part of the device 10. The means for assisting in the raising and lowering of the seat 18 provides for the smooth and controlled movement of the seat 18 as it is raised and lowered. Thus, any erratic and jerky movements in raising the seat 18 are avoided, as well as the slamming of the seat 18 against the rim of the bowl 16 when the seat 18 is lowered thereto. The means for assisting in the raising and lowering of the seat 18 includes a main or helper spring 78 which extends between the bracket 74 and the eye bolt 62. The spring 78 is an extension spring which has been slightly modified for the purposes of this device 10. The spring 78 includes a first end which is bent into a hook-shaped configuration 80 so that the first end can be attached to the eye bolt 62. The spring 78 also includes an opposite second end which may be described as the squared or ground end 82. A stud 84 is inserted into the ground end 82 so that the stud 84 is encompassed by the coils of the spring 78 adjacent the second end, and the stud 84 is secured to the coils of the spring 78 by being welded thereto. The stud 84 includes an internal threaded aperture or tapped hole (not shown) and at least one mounting nut 86 is secured to the stud 84. In the device of the present invention, two mounting nuts 86 are welded together so that their bores are in axial alignment, and then the nuts 86 are secured to the end of the stud 84 which projects slightly past the first end of the spring 78. The nuts 86, the stud 84, and the spring 78 are in axial alignment when they are assembled together.

As shown in FIGS. 1–4, the means for assisting in raising and lowering the seat 18 includes a fastener 88, such as a round head screw or a stove bolt, with its shank completely inserted through the aperture of the leg portion 76 so that a major portion of the shank of fastener 88 can be threaded into the nuts 86 and the tapped hole of the stud 84. As will be more fully explained hereinafter, rotating the fastener 88 clockwise or counterclockwise allows the individual to adjust the amount of tension on the spring 78. The amount of tension on the spring 78 determines how much assistance will be provided to lift the seat 18 and also how much resistance will be provided in the process of lowering the seat 18. The tension provided by the spring 78 is adjustable in order to accommodate the varying weights of toilet seats. When the seat 18 is in the lowered state, as shown in FIG. 3, the spring 78 is disposed in the extended state or position. When the seat 18 is raised, as shown in FIG. 4, the spring 78 is actually disposed to the relaxed state or position. The mechanical state of rest for the spring 78 is when the seat 18 is in the raised position, and the raised position allows for the interplay between the seat 18 and the spring 78 to assist in the lowering of the seat 18 when the individual removes his foot 11 from the pedal 36.

Illustrated in FIGS. 1–4 is a means to assist in the return of the seat 18 to the lowered state if the seat 18 should happen to go past the top dead center position (defined by an imaginary line extending upwardly from the base 24 and perpendicular to the floor surface 12 and base 24) during the process of raising the seat 18. The means for returning the seat 18 from past the top dead center is an over-center return spring 90 which is secured to the base 24 and projects upwardly therefrom. More specifically, a mounting stud 92 is secured to the base 24 and projects a slight distance upwardly therefrom. A lower end 94 of the spring 90 is then attached to the stud 92. The spring 90 will project upwardly and between the link arms 46 which are spaced slightly from each other; while the upper end 96 of the spring 90 is disposed adjacent to the link arm 50. If two upper link arms are used, the upper end 96 of the return spring 90 would be disposed between both upper link arms 50. A washer 98 is secured to the link arm 50 by being welded thereto and a fastener 100, such as a machine screw or stove bolt, is inserted downwardly through the washer 98 and within the coils of the end 96. The tension on the spring 90 is adjustable by rotating the fastener 100 clockwise or counterclockwise, and this causes the spring 90 to become more loosely or more tightly wound. It should be noted that the fastener 100 does not project downwardly through the entire length of the spring 90, but only needs to project perhaps one-quarter to one-third of the way into the coils of the spring 90 adjacent the end 96. Also, the diameter of the shank of the fastener 100 is such as to abut the inner surface of the coils of the spring 90 so that rotation of the fastener 100 torques the spring 90, thus varying the tension of the spring 90.

As shown in FIGS. 3–5, an elongated lifting rod or arm 102 is insertable into the tube 68. The length of the arm 102 is such as to accommodate any toilet bowl height currently available. The arm 102 is selectively positionable and repositionable within the tube 68 in a reciprocable vertical direction with respect to the base 24 so that the height of the arm 102 will be at the proper level with respect to the lowered seat 18. The arm 102 has an upper end which terminates with a tang portion 104 that projects at a right angle to the axis of the arm 102. When the device 10 is disposed in its operative position adjacent the bowl 16, the tang 104 is positioned so that it is directly under the rear of the seat 18. The device 10 includes a simple and efficient means of securing the arm 102 to the seat 18. A lifting arm mounting bracket 106 is provided that has an aperture through which the tang 104 can be inserted, and the bracket 106 is attached to the underside of the rear of the seat 18 by means of a pair of mounting bracket screws 108.

One method of set-up and operation of the device 18 will now be described. The set-up will be described in general terms since both the location at which the device 10 will be used as well as the dimensions of the particular toilet 14 will vary. Also, the manner of set-up will vary from user to user. As shown in FIGS. 3 and 4, the device 10 would be disposed adjacent and to one side of the bowl 16 so that only the pedal 36 and pedal covering 40 project in front of the bowl 16. The base 24 can be secured to the floor surface 12 by the use of fasteners or, in the alternative, the strip 30 can be secured to the floor surface 12 by means of an adhesive and then the strip 28 on the underside of the base 24 can be pressed down thereagainst to secure it to the strip 30. The base 24 can be easily lifted off the strip 30 for repositioning should this be necessary. The bracket 106 can then be secured to the underside of the seat 18 adjacent the point where the seat 18 is hinged to the bowl 16.

With the seat 18 in the up position, the individual inserts the tang 104 into the aperture of the bracket 106. The individual will have to position the base 24 of the device 10 on the floor surface 12 while inserting the tang 104 into the bracket 106. The screw 72 for the tube 68 will need to be loosened to allow the arm 102 to be moved upward or downward so that the tang 104 can be positioned in alignment with, and then inserted into, the aperture of the bracket 106. The seat 18 can then be let down. Further positioning of the device 10 alongside the bowl 16 will probably be required before the base 24 is attached to the floor surface 12 or properly positioned and attached to strip 30. The position of arm 102 can be fixed by tightening the screw 72 through the tube 68 and against the arm 102.

The appropriate spring tension for the springs 78 and 90 is the final step in the set up procedure. Viewing the head of the fastener 88 from the rear of the device 10, clockwise rotation of the fastener 88 draws the coils of the spring 78 apart, thus increasing the tension of the spring 78 which provides more upward lifting force for raising the seat 18. On the other hand, rotating the fastener 88 counterclockwise reduces the tension on the spring 78 and less upward lifting force is provided by the interplay of the spring 78 and weight of the seat 18 for raising the seat 18.

The tension of the spring 90 can now be adjusted and properly set. Viewing the spring 90 from above, clockwise rotation of the fastener 100 increases tension of the spring 90 providing for a quicker return of the seat 18 should the seat 18 momentarily move past the top dead center position, while counterclockwise rotation of the fastener 100 reduces tension of the spring 90. Rotation of the fastener 100 transmits torsion to the spring 90; but at no time does the entire body of the spring 90 rotate about its axis as the fastener 100 is being rotated because the end 94 of the spring 90 is fixed to the stud 92.

I claim:

1. A toilet seat lifting device adapted to be disposed on a floor adjacent a bowl of a water closet having a seat and secured to the seat of the water closet for selectively raising and lowering the seat, comprising:

a base disposed adjacent and beside the bowl of the water closet;

a stanchion upwardly projecting from the base;

a foot pedal pivotably mounted to the stanchion and movable from a water closet seat raising state to a water closet seat lowering state;

a linkage means pivotably mounted to the stanchion for selectively raising and lowering the seat upon actuation of the foot pedal;

an extension rod mounted to the linkage means and having an upper end for attachment to the seat;

the extension rod selectively slidably positionable along its vertical length in order to vary the location at which the extension rod is attached to the seat;

a main spring having a first end attached to the stanchion and a second end attached to the linkage means for assisting in raising the seat of the water closet and slowing down the lowering of the seat of the water closet concomitant with the pivotable movement of the linkage means; and seat return means secured to the base and projecting upwardly therefrom for pulling the seat back down toward the bowl should the water closet seat go to a position past an imaginary line perpendicular to the floor.

2. A toilet seat lifting device adapted to be disposed on a floor surface for raising and lowering a seat of a toilet, comprising:

a base adapted to be disposed on the floor surface;

a stanchion upwardly projecting from the base;

a foot pedal pivotably mounted to the stanchion and movable from a toilet seat lowering position to a toilet seat raised position in order to selectively raise and lower the toilet seat;

linkage means pivotably mounted to the stanchion for selectively raising and lowering the toilet seat upon actuation of the foot pedal;

a main spring having a first spring end attached to the stanchion and a second spring end attached to the linkage means for assisting in raising the toilet seat and for damping the lowering of the toilet seat;

an adjustable extension rod having a lower end secured to the linkage means and an upper end adapted to be secured to the toilet; and toilet seat return means for assisting in the lowering of the toilet seat and which is actuated when the toilet seat goes past an imaginary line perpendicular to the floor surface.

3. A toilet seat lifting device adapted for raising and lowering a seat of a toilet, comprising:

a base disposed adjacent the toilet;

a stanchion secured to the base;

a foot pedal pivotably secured to the stanchion and selectively movable from a toilet seat lowering position to a toilet seat raising position so that the toilet seat can be raised and lowered;

a linkage means secured to the stanchion for pivotable movement concomitant with the movement of the foot pedal in order to raise and lower the toilet seat;

a main spring having a first spring end attached to the stanchion and a second spring end attached to the linkage means for controlling the speed with which the toilet seat is raised and damping the speed with which the toilet seat is lowered;

a toilet seat return means for returning and assisting in the lowering of the toilet seat if the toilet seat temporarily moves past an imaginary vertical line perpendicular to the base; and an elongated lifing arm having a lower end secured to the linkage means and an upper end adapted to be secured to the toilet seat and which transmits an upwardly-directed force for raising the toilet seat concomitant with the pivotable movement of the foot pedal and the linkage means.

* * * * *